US006002203A

United States Patent [19]

Yokota et al.

[11] Patent Number: 6,002,203

[45] **Date of Patent: *Dec. 14, 1999**

[54] CATHODE RAY TUBE HAVING AN ENVELOPE SHAPED TO REDUCE BEAM DEFLECTION POWER REQUIREMENTS

[75] Inventors: Masahiro Yokota, Kumagaya; Yuuichi Sano, Fukaya, both of Japan; Eiji Kamohara, Horseheads, N.Y.; Tadahiro Kojima, Fukaya, Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/863,889

[22] Filed: May 28, 1997

[30] Foreign Application Priority Data

May 28, 1996 [JP] Japan ..... 8-133168

[51] Int. Cl.[6] ..... H01J 31/00

[52] U.S. Cl. ..... 313/477

[58] Field of Search ..... 313/472, 473, 313/474, 475, 476, 477

[56] References Cited

U.S. PATENT DOCUMENTS

| | | | |
|---|---|---|---|
| 3,087,085 | 4/1963 | Truner | 313/92 |
| 3,146,368 | 8/1964 | Fiore et al. | 313/92 |
| 3,591,035 | 7/1971 | Gossie | 220/2.1 A |
| 3,720,345 | 3/1973 | Logue | 220/2.1 A |
| 3,731,129 | 5/1973 | Tsuneta et al. | 313/64 |
| 4,065,695 | 12/1977 | Van Der Waal | 313/466 |
| 4,990,824 | 2/1991 | Vriens et al. | 313/474 |
| 5,258,688 | 11/1993 | Fondrk | 313/477 R |

FOREIGN PATENT DOCUMENTS

| | | |
|---|---|---|
| 2.033.159 | 11/1970 | France . |
| 2054280 | 5/1971 | Germany . |
| 0 809 273 A2 | 11/1997 | Germany . |
| 48-34349 | 10/1973 | Japan . |
| 8-7792 | 1/1996 | Japan . |

*Primary Examiner*—Vip Patel
*Assistant Examiner*—Matthew J. Gerike
*Attorney, Agent, or Firm*—Pillsbury, Madison & Sutro, LLP

[57] ABSTRACT

A cathode ray tube includes a vacuum envelope having a substantially rectangular panel, a cylindrical neck, and a funnel connecting the panel and the neck. A phosphor screen arranged on the inner surface of the panel generates luminescence upon impingement of electron beams, which are generated by an electron gun assembly disposed in the neck. In order to create a image visible through the panel, a deflection yoke is mounted on the outer surface of the funnel to generate a magnetic field in the funnel, deflect the electron beams, and thereby scan the phosphor screen. According to the present invention, the portion of the funnel over which the deflection yoke is mounted is formed such that the power required to generate a deflection field capable of scanning substantially the entire phosphor screen may be reduced. To this end, the funnel is formed over a predetermined range along a first axis coincident with the axis of symmetry of the cylindrical neck such that at least one cross section of the inner and outer funnel perpendicular to the first axis has a non-circular shape and a maximum diameter along a direction other than those of the major and minor axes of the substantially rectangular panel. Moreover, within this predetermined range, the point on the funnel's cross section that is furthest from the first axis is not located along the direction of the panel's diagonal axis.

5 Claims, 7 Drawing Sheets

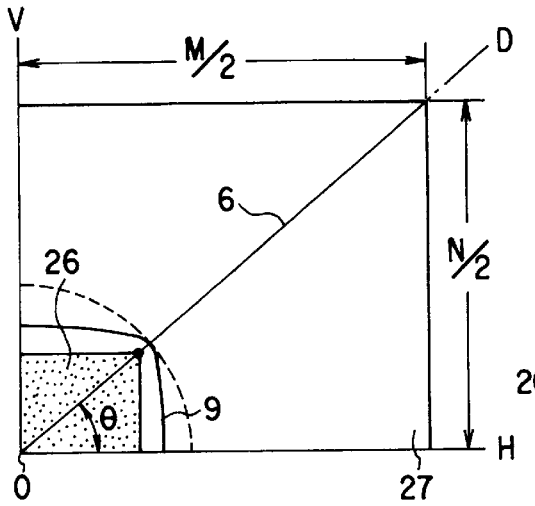
FIG. 7
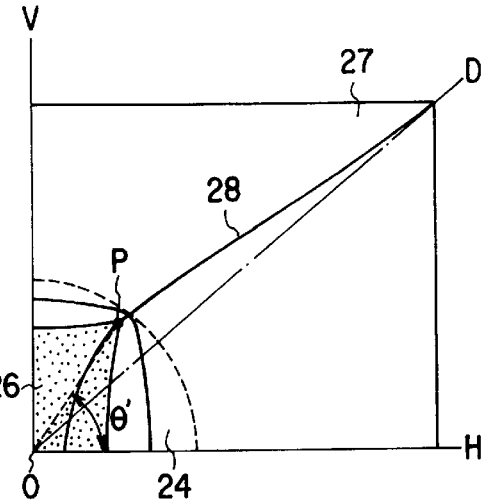
FIG. 8
| TYPE OF TUBE | H : V | θ | θ'min | θ-θ'min | θ'max | θ'max-θ |
|---|---|---|---|---|---|---|
| CDT-A | 4 : 3 | 36.87 | 22.5 | -14.4 | 35.4 | -1.5 |
| CDT-B | 4 : 3 | 36.87 | 17.3 | -19.6 | 34.8 | -2.1 |
| CDT-C | 4 : 3 | 36.87 | 20.9 | -16.0 | 36.3 | -0.6 |
| CDT-D | 4 : 3 | 36.87 | 21.3 | -15.6 | 38.1 | 1.2 |
| CDT-E | 4 : 3 | 36.87 | 17.3 | -19.6 | 37.8 | 0.9 |
| CDT-F | 4 : 3 | 36.87 | 24.1 | -12.8 | 37.2 | 0.3 |
| CDT-G | 4 : 3 | 36.87 | 27.6 | -9.3 | 41.5 | 4.6 |
| CDT-H | 4 : 3 | 36.87 | 21.2 | -15.7 | 39.6 | 2.7 |
| CDT-I | 3 : 4 | 53.13 | 36.7 | -16.4 | 54.3 | 1.2 |
FIG. 9

CATHODE RAY TUBE HAVING AN ENVELOPE SHAPED TO REDUCE BEAM DEFLECTION POWER REQUIREMENTS

BACKGROUND OF THE INVENTION

The present invention relates to a cathode ray tube, e.g., a color picture tube, and more particularly, to a cathode ray tube capable of effectively decreasing the consumption power of the deflection yoke and the leakage magnetic field generated by the deflection yoke.

FIG. 1A shows a color picture tube as an example of a conventional cathode ray tube. This color picture tube has a vacuum envelope. The vacuum envelope is formed with a substantially rectangular glass panel 1, a glass funnel 2 formed contiguous to the panel 1, and a cylindrical glass neck 3 formed contiguous to the small-diameter end portion of the funnel 2. As shown in FIG. 1B, a substantially rectangular phosphor screen 4 including three dot-like or stripe-like color phosphor layers respectively emitting blue, green, and red light is formed on the inner surface of the panel 1.

An electron gun assembly 7 for emitting three electron beams 6 is arranged in the neck 3. This electron gun assembly 7 is an in-line electron gun assembly that emits the three electron beams 6 arranged in a line on the same horizontal plane.

A deflection yoke 8 is mounted on the outer side of the funnel 2 near the neck 3 side. The deflection yoke 8 generates a pincushion type horizontal deflection field and a barrel type vertical deflection field.

The three electron beams 6 arranged in a line and emitted from the electron gun assembly 7 are deflected by the horizontal and vertical deflection fields generated by the deflection yoke 8 in a horizontal direction H and a vertical direction V. Hence, when they reach the phosphor screen 4 through a shadow mask, the three electron beams 6 arranged in a line converge on the entire portion of the phosphor screen 4, i.e., on the entire screen surface without requiring an extra correction unit, and horizontally and vertically scan the phosphor screen 4, thereby displaying a color image.

A color picture tube having this structure is called a self convergence in-line color picture tube and is widely in use.

In such a cathode ray tube, e.g., a color picture tube, it is important to decrease the consumption power of the deflection yoke 8 which is the maximum power consumption source. More specifically, in order to improve the screen luminance, the anode voltage for finally accelerating the electron beams must be increased. In order to cope with OA equipments, e.g., a HDTV or a High-Definition TV and a PC or a Personal Computer, the deflection frequency must be increased. An increase in anode voltage and an increase in deflection frequency cause an increase in deflection power, i.e., an increase in consumption power of the deflection yoke. In particular, when the electron beams are deflected with a high frequency, the deflection field tends to leak to the outside of the cathode ray tube. For this reason, for a PC in which the operator sits close to the cathode ray tube, regulations against the leakage magnetic field are strict.

In order to decrease the leakage magnetic field, conventionally, a method of adding a compensation coil is generally employed. When, however, a compensation coil is added, the consumption power of the PC increases accordingly. Therefore, in order to decrease the deflection power and the leakage magnetic field, it is preferable to decrease the neck diameter of the cathode ray tube and the outer diameter of the funnel near the neck side on which the deflection yoke is mounted, so that the deflection field efficiently acts on the electron beams.

In the cathode ray tube, when an electron beam is deflected in a direction along the maximum size of the screen, i.e., along the diagonal direction, the deflection angle of the electron beam, i.e., the angle the trace of the deflected electron beam makes with the axis of the neck becomes large. When the deflection angle of the electron beam increases, the electron beam passes closely to the inner surface of the funnel near the neck side on which the deflection yoke is mounted. For this reason, if the neck diameter and the outer diameter of the funnel near the neck side are simply decreased, the outer electron beam 6 bombards the inner wall of the funnel 2 near the neck 3 side, as shown in FIG. 1A. A portion 10 where the electron beam 6 does not reach is thus formed on the phosphor screen 4, as shown in FIG. 1B.

Therefore, in the conventional cathode ray tube, the neck diameter and the outer diameter of the funnel near the neck side cannot be simply decreased. Accordingly, it is difficult to decrease the deflection power and the leakage magnetic field. If the electron beams 6 continue to bombard the inner wall of the funnel 2 near the neck 3 side, the temperature of this portion rises to melt the glass. Then, a portion of the inner wall of the funnel becomes thin, and the funnel may break at this portion.

In order to solve these problems, Jpn. Pat. Appln. KOKOKU Publication No. 48-34349 discloses a cathode ray tube 12 as shown in FIG. 2A. This tube is developed based on the fact that when drawing a rectangular raster on a phosphor screen, a passing region which is defined by the trace of an electron beam passing inside the funnel near the neck side on which the deflection yoke is mounted also becomes substantially rectangular. More specifically, in this cathode ray tube 12, as shown in FIGS. 2B to 2F showing the sections of the cathode ray tube 12 taken along the lines IIB—IIB to IIF—IIF, respectively, the section of a funnel 2 near the neck 3 side toward the panel 1 side, on which the deflection yoke is mounted, gradually changes from a circular shape to a substantially rectangular shape through an elliptic shape.

In a cathode ray tube whose funnel near the neck side on which a deflection yoke is mounted is formed with sections as shown in FIGS. 2B to 2F, the inner diameter of the corner portion, i.e., a portion near the diagonal axis (D axis), where the electron beams tend to land, becomes large, as shown in FIG. 3, as compared to that in a cathode ray tube whose funnel 2 near the neck side remains circular. This prevents the electron beams from impinging on the inner wall of the funnel.

In the cathode ray tube having a structure as shown in FIGS. 2B to 2F, its inner diameter near the major axis, i.e., the horizontal axis (H axis), and its inner diameter near the minor axis, i.e., the vertical axis (V axis), become shorter than in the cathode ray tube whose funnel 2 near the neck side remains circular. This aims at setting the horizontal deflection coil and the vertical deflection coil of the deflection yoke to be closer to the passing region of the electron beams in order to efficiently deflect the electron beams, thereby decreasing the deflection power.

In this cathode ray tube, however, when the section of the funnel near the neck side on which the deflection yoke is mounted becomes closer to a rectangle, the atmospheric pressure resistance decreases, and safety is impaired. Therefore, in practice, the shape of the funnel near the neck side must be appropriately rounded, and the deflection power and the leakage magnetic field cannot thus be decreased sufficiently.

As described above, it is very difficult to realize a decrease in deflection power and leakage magnetic field of a cathode ray tube while satisfying demands for a higher luminance and a higher frequency required by a display equipment, e.g., a HDTV and a PC. Conventionally, in a structure proposed to reduce the deflection power of a cathode ray tube, the shape of a funnel near the neck side toward the panel side, on which a deflection yoke is mounted, gradually changes from a circular shape to a substantially rectangular shape through an elliptic shape.

When, however, the section of the funnel near the neck side becomes closer to a rectangle in this manner, the atmospheric pressure resistance suffers, impairing the safety. Therefore, in practice, the shape of the funnel near the neck side must be appropriately rounded, and the deflection power cannot thus be decreased sufficiently. Also, at the time the above mentioned reference was published, the simulation techniques for designing the shape of the envelope of the cathode ray tube were not mature yet, and electron beam trace analysis and deflection field analysis as accurate as those nowadays done could not be performed. Therefore, a funnel that could decrease the deflection power and the leakage magnetic field while maintaining the atmospheric pressure resistance could not be designed.

BRIEF SUMMARY OF THE INVENTION

The present invention has been made to solve the above problems, and has as its object to provide a cathode ray tube capable of reducing the deflection power and the leakage magnetic field and preventing a decrease in atmospheric pressure resistance while satisfying demands for a higher luminance and a higher frequency.

According to the present invention, there is provided a cathode ray tube comprising:

- a vacuum envelope having a substantially rectangular panel, a cylindrical neck, and a funnel connecting the panel and the neck;
- an electron gun assembly disposed in the neck to generate electron beams;
- a substantially rectangular phosphor screen arranged on the inner surface of the panel to generate luminescence upon impingement of the electron beams; and
- a deflection yoke mounted on the outer surface of the funnel over a predetermined range along a first axis coincident with the axis of symmetry of the cylindrical neck, to generate a magnetic field in the funnel, deflect the electron beams along second and third axes perpendicularly intersecting the first axis and perpendicularly intersecting each other and parallel to the major and minor axes of the panel, respectively, and thereby scan the phosphor screen, wherein within this predetermined range of the funnel, at least one cross section of inner and outer funnel perpendicular to the first axis is formed to a non-circular shape having a maximum diameter along a direction other than the second and third axes, and within this predetermined range along the first axis, the point on the funnel's cross section (in a plane perpendicular to the first axis) that is furthest from the first axis is not located along the direction of the panel's diagonal axis.

With the cathode ray tube according to the present invention, since the outer or inner shape of the funnel within the predetermined range is formed to have a structure as described above, the deflection yoke to be mounted over the predetermined range of the funnel can be made compact while satisfying demands for a higher luminance and a higher frequency. Also, this deflection yoke can be arranged close to the electron beam passing region. As a result, a deflection power corresponding to the power consumption of the deflection yoke, and a leakage magnetic field from the deflection yoke can be decreased. With this structure, a cathode ray tube having a sufficiently large atmospheric pressure resistance can be provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 7 is a graph for explaining the relationship between the shape of the intermediate funnel region and the electron beam passing region of the conventional cathode ray tube;

FIG. 8 is a graph for explaining the relationship between the shape of the intermediate funnel region and the electron beam passing region of the color picture tube of the first embodiment shown in FIG. 5;

FIG. 9 is a table showing the maximum and minimum values of $\theta'(z)$ of nine types of cathode ray tubes CDT-A to CDT-I having different conditions;

DETAILED DESCRIPTION OF THE INVENTION

A color picture tube according to an embodiment of the present invention as an example of a cathode ray tube will be described with reference to the accompanying drawing.

Figure 4:
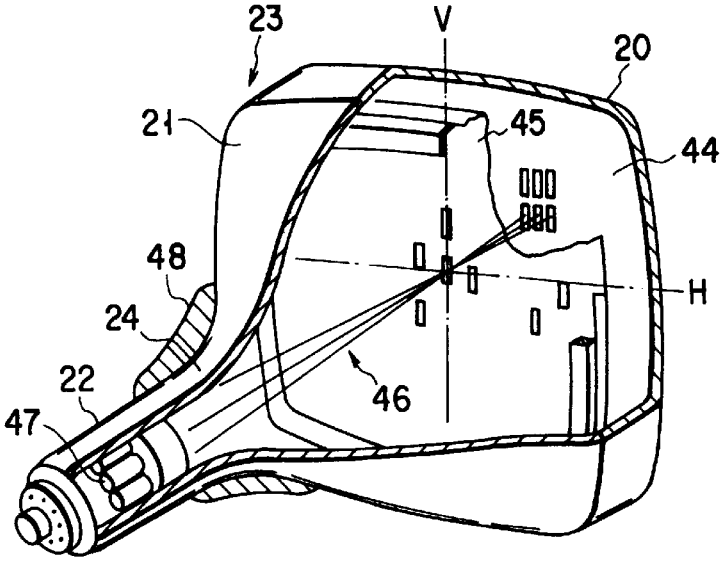
FIG. 4 is a view schematically showing the structure of a cathode ray tube, i.e., a color picture tube, according to an embodiment of the present invention.

As shown in FIG. 4, this color picture tube has a vacuum envelope 23. The vacuum envelope 23 is formed with a substantially rectangular glass panel 20, a glass funnel 21 formed contiguous to the panel 20, and a cylindrical glass neck 22 formed contiguous to the small-diameter end portion of the funnel 21. A substantially rectangular phosphor screen 44 including three dot-like or stripe-like color phosphor layers respectively emitting blue, green, and red light is formed on the inner surface of the panel 20. A shadow mask 45 having a large number of electron beam apertures is arranged inside the phosphor screen 44 to oppose it, i.e., on the neck side of the phosphor screen 44.

An electron gun assembly 47 for emitting three electron beams 46 is disposed in the neck 22. This electron gun assembly 47 is an in-line electron gun assembly that emits the three electron beams 46 arranged in a line on the same horizontal plane.

A deflection yoke 48 is mounted on the funnel 21 near the neck 22 side, i.e., on the outer side of an intermediate funnel region 24 of the funnel 21. The deflection yoke 48 generates a pincushion type horizontal deflection field and a barrel type vertical deflection field.

The three electron beams 46 emitted from the electron gun assembly 47 are deflected by the horizontal deflection field generated by the deflection yoke 48 in the major axis direction, i.e., the horizontal axis (H axis) direction. Also, these three electron beams 46 are deflected by the vertical deflection field generated by the deflection yoke 48 in the minor axis direction, i.e., the vertical axis (V axis) direction. Hence, when the three electron beams 46 arranged in a line and emitted from the electron gun assembly 47 reach the phosphor screen 44 through the shadow mask 45, they horizontally and vertically scan the entire portion of the phosphor screen 44, i.e., the entire screen, thereby displaying a color image.

A color picture tube having this structure is called a self convergence in-line color picture tube as the three electron beams 46 arranged in a line converge on the entire surface of the screen without requiring an extra correction unit.

Figure 5:
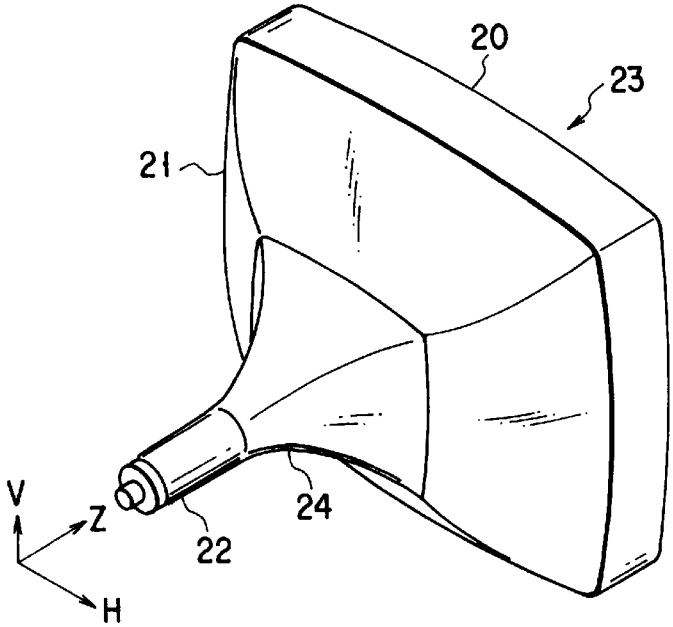
FIG. 5 is a view showing a vacuum envelope applied to a color picture tube according to the first embodiment of the present invention.

FIG. 5 shows the structure of a vacuum envelope 23 according to the first embodiment.

The vacuum envelope 23 according to the first embodiment has a panel 20 formed such that a phosphor screen having an aspect ratio, i.e., the ratio of the length along the H axis and the length along the V axis, of 4:3 can be disposed on it. More specifically, assuming that the tube axis of the vacuum envelope 23, which coincides with the central axis of the cylindrical neck, is defined as the Z axis, the section of the panel 20 perpendicularly intersecting the Z axis has a substantially rectangular shape defined by the long sides of the panel substantially parallel to the major axis and the short sides of the panel substantially parallel to the minor axis. The ratio of the long sides to the short sides of this panel 20 is substantially equal to the aspect ratio of the phosphor screen, which is substantially 4:3.

The section of the neck 22 in a plane perpendicularly intersecting the Z axis has a circular shape.

Regarding an intermediate funnel region 24 of a funnel 21 connecting the panel 20 and the neck 22, its section in a plane perpendicularly intersecting the Z axis changes along the Z axis. This intermediate funnel region 24 includes a region on which the deflection yoke is to be mounted.

The section of the intermediate funnel region 24 from the neck 22 side to the panel 20 side along the Z axis gradually changes from a circular shape similar to that of the neck 22 to a non-circular shape having the maximum diameter along a direction other than the major and minor axes of the panel 20. In other words, at the panel 20 side, the section of the intermediate funnel region 24 has a rectangular shape similar to a substantially rectangular shape defined by the long sides substantially parallel to the major axis of the panel and the short sides substantially parallel to the minor axis of the panel. When the section of the intermediate funnel region 24 is rectangular, the direction of the maximum dimension other than the major and minor axes is parallel to the diagonal direction of the panel 20, i.e., the diagonal axis (D axis).

Figure 6:
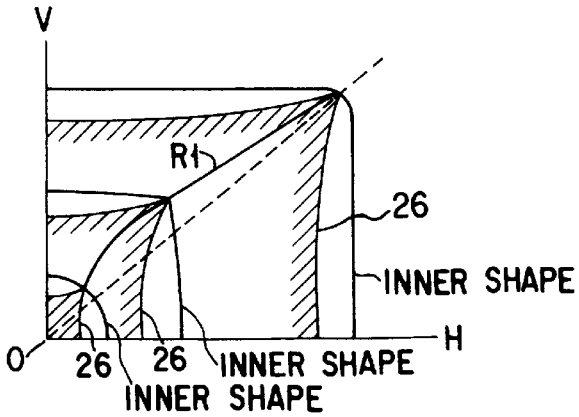
FIG. 6 is a graph showing the trace of the ridge of an intermediate funnel region extending from the neck to the panel of the vacuum envelope shown in FIG. 5.

FIG. 6 shows in a solid line R1 the trace of the ridge of the intermediate funnel region 24 extending from the neck 22 to the panel 20.

As shown in FIG. 6, of the inner and outer shapes of the section of the intermediate funnel region 24, at least the inner shape from the neck 22 side to the panel 20 side is gradually deformed from a circular shape to a non-circular shape having its maximum diameter along a direction other than the major and minor axes of the panel 20, i.e., to a rectangular shape. In addition, the section of the intermediate funnel region 24, which is taken at an arbitrary point on the Z axis and perpendicular to the Z axis, is formed such that the angle which the line connecting between an arbitrary point O on the Z axis and a point corresponding to the maximum diameter position of the funnel forms with reference to the H axis differs, depending upon the position on the Z axis. Solid line R1 in FIG. 6 corresponds to the trace of the ridge which enables the funnel to have a maximal diameter at an arbitrary position on the Z axis.

In other words, the intermediate funnel region 24 is formed in such a manner that the trace of its ridge, as viewed in a cross section perpendicular to the Z axis, satisfies the following relationship:

$$\tan\theta > N/M$$

where θ is the angle formed between the H axis and the straight line connecting the intersection O between the Z axis and said cross section and the point corresponding to the maximum diameter of the funnel, and N/M is the aspect ratio of the phosphor screen.

Where the aspect ratio of the phosphor screen is 4:3 as in the first embodiment described above, the intermediate funnel region 24 is formed in such a manner that the trace of its ridge satisfies the following relationship:

$$\tan\theta > 3/4.$$

Figure 1A:
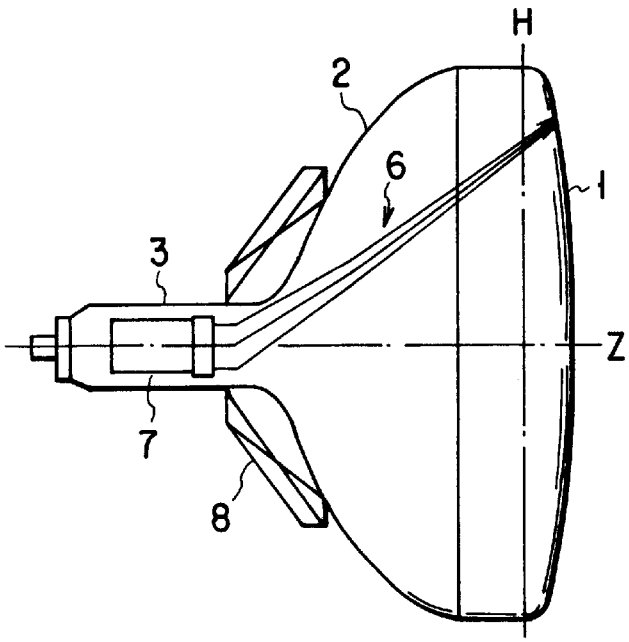
FIG. 1A (PRIOR ART)
FIG. 1A is a sectional view showing a conventional cathode ray tube.
Figure 1B:
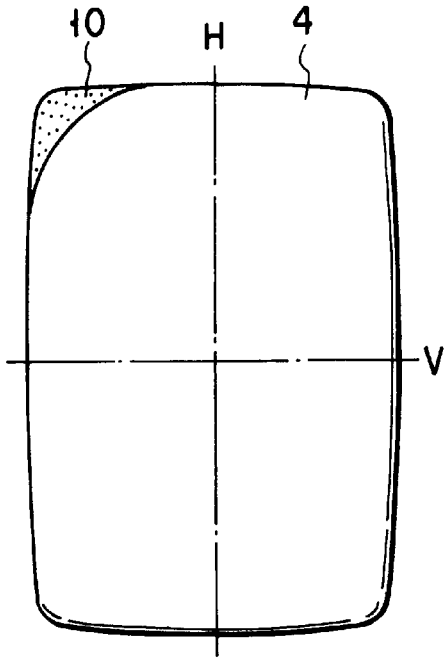
FIG. 1B (PRIOR ART)
FIG. 1B is a front view of the cathode ray tube shown in FIG. 1A.
Figure 3:
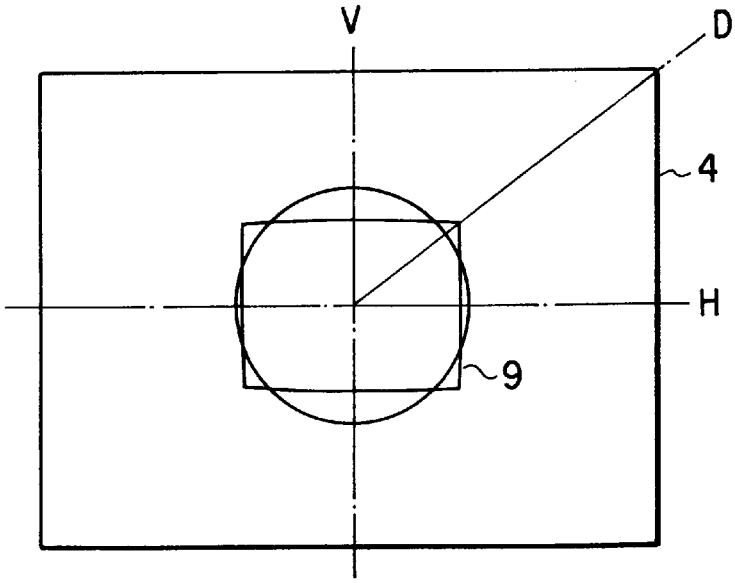
FIG. 3 (PRIOR ART)
FIG. 3 is a view for explaining an electron beam passing region obtained when a funnel near the neck side on which a deflection yoke is mounted is substantially rectangular.
Figure 2A:
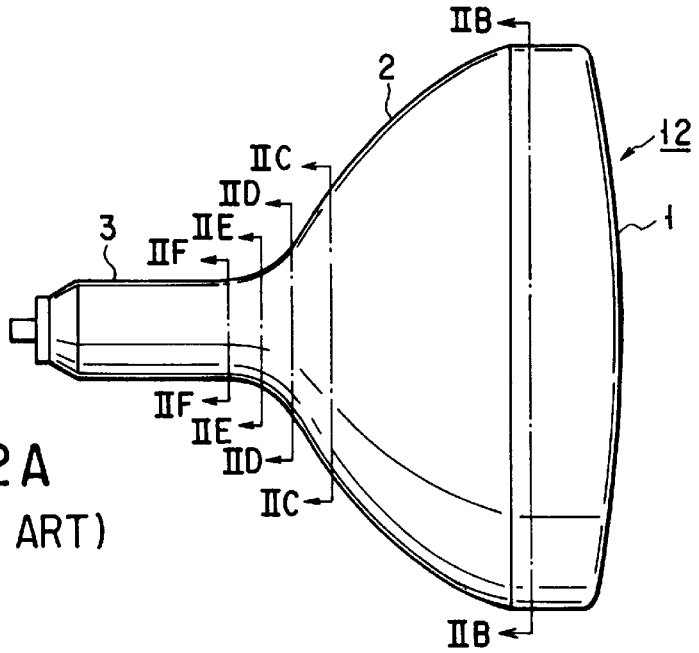
FIG. 2A (PRIOR ART)
FIG. 2A is a side view of the conventional cathode ray tube.
Figure 2B:
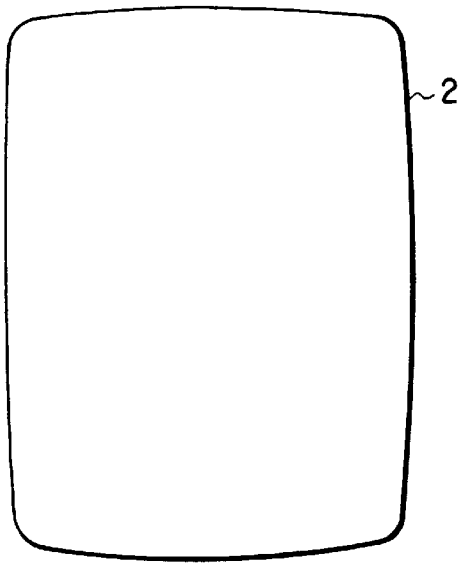
FIG. 2B (PRIOR ART)
FIGS. 2B to 2F are sectional views taken along the lines IIB—IIB to IIF—IIF, respectively, of FIG. 2A.
Figure 2C:
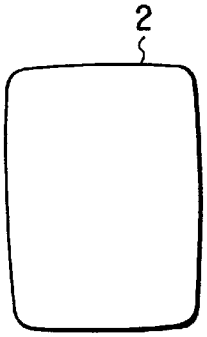
FIG. 2C (PRIOR ART)
Figure 2D:
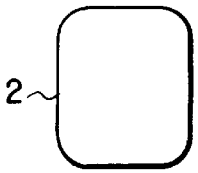
FIG. 2D (PRIOR ART)
Figure 2E:
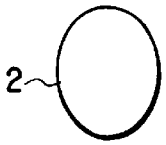
FIG. 2E (PRIOR ART)
Figure 2F:
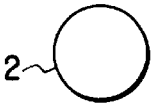
FIG. 2F (PRIOR ART)

In the conventional cathode ray tube 12 shown in FIGS. 2A to 2F, the passing region of the electron beam 6 of the funnel near the neck side as shown in FIG. 2D was supposed to form a rectangular shape having as the corner portion the passing position of the electron beam 6 that reaches the corner portion of a screen 27. More specifically, a funnel cross section perpendicular to the Z axis and located at an arbitrary point on the Z axis has its θ satisfy the following relationship:

$$\tan\theta = N/M$$

where N/M is the aspect ratio of the phosphor screen.

However, when the trace of the three electron beams emitted from the in-line electron gun assembly and arranged in a line along the H axis, and the deflection field generated by the deflection yoke were analyzed, a trace 28 of an electron beam in the intermediate funnel region 24 was found to be not parallel to the D axis, and the passing region 26 of this electron beam was found to be distorted to have a pincushion shape, as shown in FIG. 8.

In general, when the horizontal and vertical deflection fields generated by the deflection yoke have a pincushion shape and a barrel shape, respectively, the center of the vertical deflection field is on the neck side of the center of the horizontal deflection field. Therefore, the electron beam that reaches the corner portion of the screen is deflected relatively strongly along the vertical direction on the neck side, and is then gradually deflected along both the horizontal and vertical directions as it is closer to the panel. As a result, the electron beam reaches the diagonal axis of the screen while drawing the trace 28 as shown in FIG. 8 and forms a passing region 26 distorted into a pincushion shape.

When utilizing an in-line electron gun assembly, the corner portion of the passing region 26 is located on a trace along which a side beam among the three electron beams arranged in a line reaches the corner portion of the screen.

Therefore, in a color picture tube whose phosphor screen has an aspect ratio of 4:3, assuming that the angle between the H axis and a straight line connecting the Z axis and an arbitrary position P on the trace 28 of the side beam reaching the corner portion of the screen 27 in a cross section perpendicular to the Z axis and located at an arbitrary point on the Z axis is defined as θ' (z), this θ' (z) sharply increases from zero at the neck-side end portion of the intermediate funnel region 24, as shown in FIG. 8. Inside a portion on which the deflection yoke is to be mounted, θ' (z) exceeds an angle between the H axis and the diagonal axis of the phosphor screen or the D axis, i.e., $$\tan^{-1}(3/4)=36.87^\circ$$

This θ' (z) changes to gradually decrease from a portion near the phosphor screen near the end portion side on which the deflection yoke is to be mounted, and reaches the corner portion of the screen. The maximum and minimum values of θ' (z) change depending on the various conditions, e.g., the structure of the cathode ray tube, the neck diameter, the deflection angle, the characteristics of the deflection field, and the like. For example, the larger the deflection magnetic field characteristics, i.e., the non-uniformity of the deflection field and the larger the difference between the center of the vertical deflection field and the center of the horizontal deflection field, the larger the maximum value of θ' (z). In some 1100 deflection tubes whose phosphor screen has an aspect ratio of 4:3, the maximum value of θ' (z) is about 41°.

FIG. 9 shows the minimum and maximum values of θ' (z) of nine types of cathode ray tubes CDT-A to CDT-I having different conditions. θ'min represents the minimum value of an angle between the H axis and the straight line perpendicular to the Z axis and connecting the Z axis and a position of the end portion of the intermediate funnel region near the neck side where the side beam directed to the corner portion of the screen passes. θ'max represents the maximum value of an angle between the H axis and the straight line perpendicular to the Z axis and_connecting the Z axis and a position in the intermediate funnel region where the side beam directed to the corner portion of the screen passes.

As shown in FIG. 9, in all the nine tube types, the end portions of the funnel intermediate portions near the neck sides are formed such that θ' is equal to θ−20° or more, and the funnel intermediate portion is formed such that the maximum value of θ' is equal to θ+10° or less. In other words, assuming that the arc tangent of the aspect ratio of the phosphor screen is defined as θ, the intermediate funnel region is formed such that θ' falls within the range of $$\theta-20^\circ \leqq \theta' \leqq \theta+10^\circ$$

The color picture tube described above according to the first embodiment is designed based on the result obtained through simulation analysis of the electron beam trace and the deflection field generated by the deflection yoke.

When the funnel 21 is formed in this manner, the deflection yoke mounted on the outer side of the intermediate funnel region 24 can be formed compactly while avoiding impingement of the electron beams on the funnel 21 along the diagonal axis. Also, the deflection yoke can be mounted to be close to the passing region where the electron beam passes. As a result, the deflection power and the leakage magnetic field can be reduced while satisfying demands for a higher luminance and a higher deflection frequency.

The structure of a vacuum envelope 223 according to the second embodiment will be described.

Figure 10:
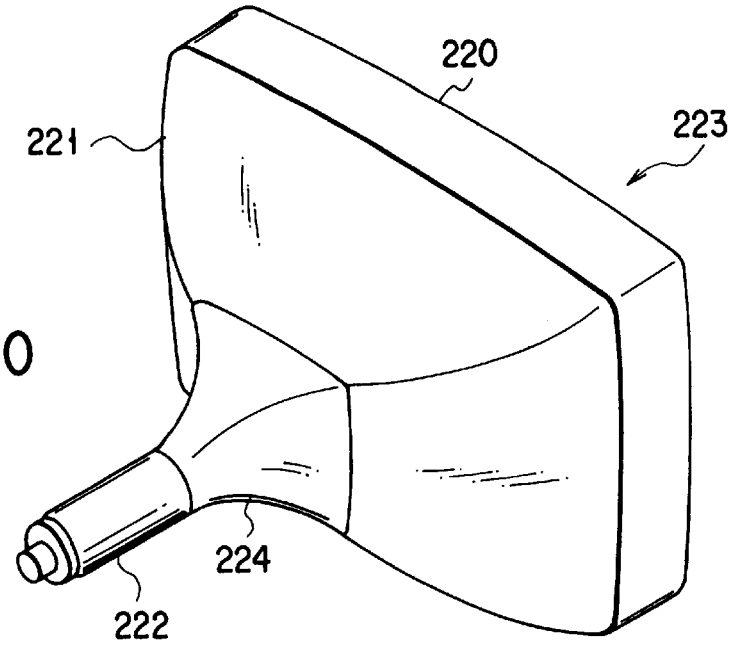
FIG. 10 is a view showing a vacuum envelope applied to a color picture tube according to the second embodiment of the present invention.

FIG. 10 shows a color picture tube having the vacuum envelope 223 according to the second embodiment. This color picture tube is horizontally elongated and has a phosphor screen having an aspect ratio of 16:9. This vacuum envelope 223 has a panel 220, a neck 222, and a funnel 221. The ratio of the long side to the short side of the panel 220 is 16:9, which is substantially equal to the aspect ratio of the phosphor screen. A section of the neck 222 in a plane perpendicularly intersecting the Z axis is circular. The funnel 221 connects the panel 220 and the neck 222. The remaining arrangement of this color picture tube is the same as that of the color picture tube of the first embodiment, and a detailed description thereof will therefore be omitted.

A section of a region of the funnel 221 on which a deflection yoke is to be mounted, i.e., a section of an intermediate funnel region 224 in a plane which perpendicularly intersects the Z axis changes along the Z axis.

In the same manner as in the first embodiment, the section of this intermediate funnel region 224 from the neck 222 side to the panel 220 side along the Z axis gradually changes from a circular shape similar to that of the neck 222 to a non-circular shape having the maximum diameter along a direction other than the major and minor axes of the panel 220.

Figure 11:
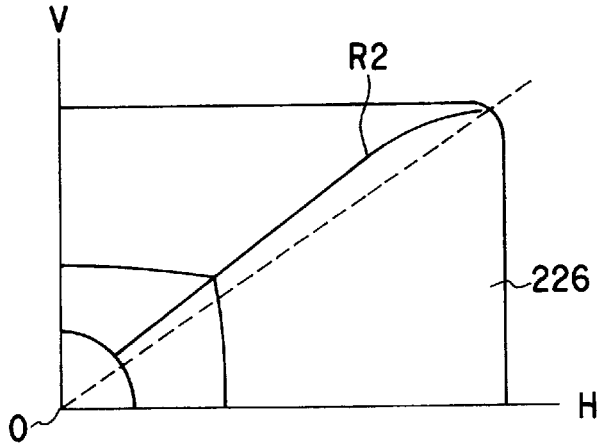
FIG. 11 is a graph showing the trace of the ridge of an intermediate funnel region extending from the neck to the panel of the vacuum envelope shown in FIG. 10.

FIG. 11 shows in a solid line R2 the trace of the ridge of the intermediate funnel region 224 extending from the neck 222 to the panel 220.

As shown in FIG. 11, of the inner and outer shapes of the section of the intermediate funnel region 224, at least the inner shape from the neck 22 side to the panel 20 side is gradually deformed from a circular shape to a non-circular shape having its maximum diameter along a direction other than the major and minor axes of the panel 220, i.e., to a rectangular shape. In addition, the section of the intermediate funnel region 224 which is perpendicular to the Z axis and located at an arbitrary point on the Z axis is formed such that, an angle 0 between the H axis and a straight line connecting the intersection O between the section and the Z axis and a point corresponding to the maximum diameter of the funnel changes depending on a position along the Z axis. In FIG. 11, R2 corresponds to the trace of the ridge that permits the diameter to become the maximum at an arbitrary position along the Z axis.

In particular, in this second embodiment, the funnel 221 is so designed that angle θ is set larger than the angle between the diagonal axis of the phosphor screen and the H axis.

This is because, in the horizontally elongated color picture tube whose phosphor screen has an aspect ratio of 16:9, if the section of the intermediate funnel region 224 on which the deflection yoke is mounted has a non-circular shape having the maximum diameter along a direction other than the major and minor axes of the panel 220, the way of setting the angle θ influences the atmospheric pressure resistance of the vacuum envelope 223.

Figure 12:
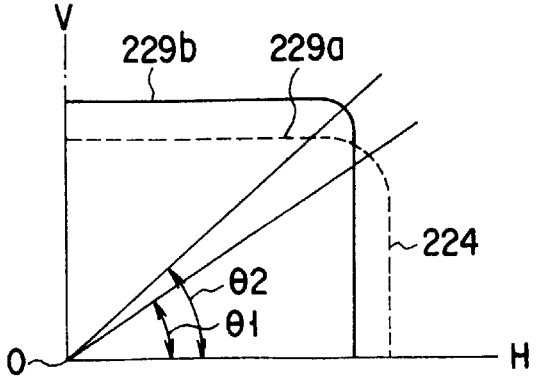
FIG. 12 is a graph for explaining the atmospheric pressure resistance of the vacuum envelope of the second embodiment shown in FIG. 10.

More specifically, in the horizontally elongated color picture tube whose phosphor screen has an aspect ratio (M:N) of 4:3 or 16:9, if the angle θ in the intermediate funnel region is set equal to an angle θ1 between the H axis and the diagonal axis of the screen, as indicated by a broken line in FIG. 12, to satisfy $$\tan\theta=\tan\theta 1=N/M$$

then the atmospheric pressure resistance of the long side of the intermediate funnel region 224 at the substantially intermediate position, i.e., of a side wall 229*a* near the V axis is degraded extremely. For this reason, the side wall 229*a* near the long side of such a funnel must be rounded to a certain degree such that its diameter is large near the V axis. As a result, the diameter of the intermediate funnel region 224 becomes large, and the diameter of the deflection yoke near the V axis cannot be sufficiently decreased.

In contrast to this, if the angle θ of the intermediate funnel region 224 is set equal to an angle θ2 between the H axis and the diagonal axis of a rectangle obtained by decreasing the length along the H axis and increasing the length along the V axis of a rectangle having an aspect ratio M:N, such that it satisfies $$\tan\theta=\tan\theta 2>N/M$$

then the section of the intermediate funnel region 224 becomes close to a square, and the atmospheric pressure resistance of a side wall 229*b* near the V axis can be increased. More specifically, the closer θ is to 45° (i.e., the closer tan θ is to 1), the larger the atmospheric pressure resistance becomes, and the smaller the outer shape along the H or V axis becomes. Hence, the diameter of the deflection yoke can also be decreased.

In the horizontally elongated color picture tube whose phosphor screen has an aspect ratio of 16:9, the intermediate funnel region is designed in such as a manner as to satisfy:

$$\tan\theta>9/16$$

With this structure, the electron beam is prevented from impinging on the inner surface of the intermediate funnel region, and the high atmospheric pressure resistance of the vacuum envelope 223 can be firmly maintained, thereby improving the performance of the color picture tube.

Hence, when the funnel 221 is formed as described above, the deflection yoke to be mounted on the outer side of the intermediate funnel region 224 can be made more compact, and this deflection yoke can be mounted close to the electron beam passing region. As a result, the deflection power and the leakage magnetic field can be reduced while satisfying demands for a higher luminance and a higher deflection frequency, and a degradation in atmospheric pressure resistance of the vacuum envelope can be avoided.

The structure of a vacuum envelope 323 according to the third embodiment will be described.

Figure 13:
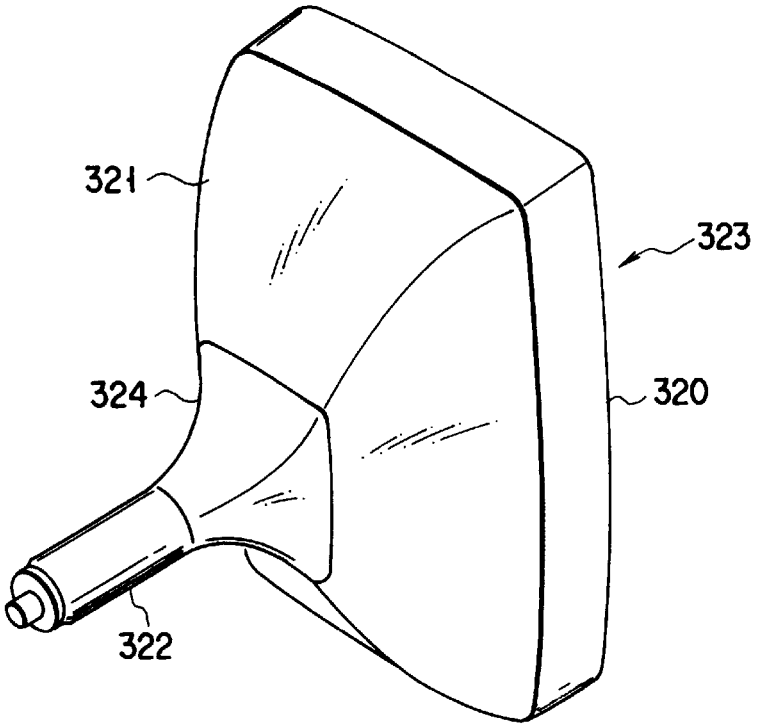
FIG. 13 is a view showing a vacuum envelope applied to a color picture tube according to the third embodiment of the present invention.

FIG. 13 shows a color picture tube having the vacuum envelope 323 according to the third embodiment. This color picture tube is vertically elongated and has a phosphor screen having an aspect ratio of 9:16. This vacuum envelope 323 has a panel 320, a neck 322, and a funnel 321. The ratio of the long side to the short side of the panel 320 is 9:16, which is substantially equal to the aspect ratio of the phosphor screen. A section of the neck 322 in a plane perpendicularly intersecting the Z axis is circular. The funnel 321 connects the panel 320 and the neck 322. The remaining arrangement of this color picture tube is the same as that of the color picture tube of the first embodiment and a detailed description thereof will therefore be omitted.

A section of a region of the funnel 321 on which a deflection yoke is to be mounted, i.e., a section of an intermediate funnel region 324 in a plane which perpendicularly intersects the Z axis changes along the Z axis.

In the same manner as in the first embodiment, the section of this intermediate funnel region 324 from the neck 322 side to the panel 320 side along the Z axis gradually changes from a circular shape similar to that of the neck 322 to a non-circular shape having the maximum diameter along a direction other than the major and minor axes of the panel 320.

Figure 14:
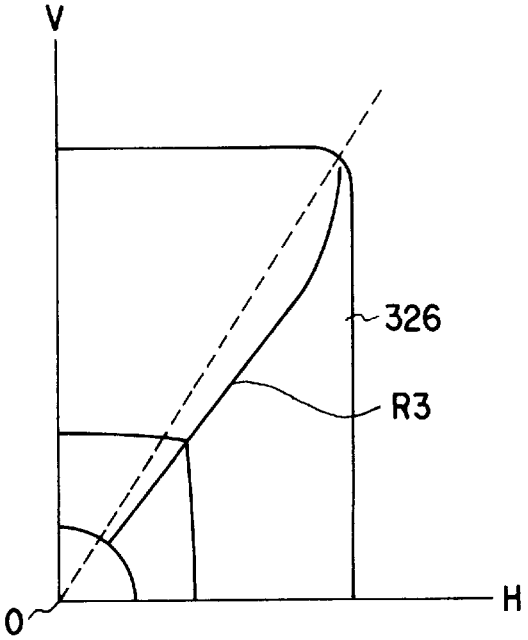
FIG. 14 is a graph showing the trace of the ridge of an intermediate funnel region extending from the neck to the panel of the vacuum envelope shown in FIG. 13.

FIG. 14 shows in a solid line R3 the trace of the ridge of the intermediate funnel region 324 extending from the neck 322 to the panel 320.

As shown in FIG. 14, of the inner and outer shapes of the section of the intermediate funnel region 324, at least the inner shape from the neck 322 side to the panel 320 side is gradually deformed from a circular shape to a non-circular shape having its maximum diameter along a direction other than the major and minor axes of the panel 320, i.e., to a rectangular shape. In addition, the section of the intermediate funnel region 324 which is perpendicular to the Z axis and located at an arbitrary point on the Z axis is formed such that, an angle θ between the H axis and a straight line connecting the intersection O between the section and the Z axis and a point corresponding to the maximum diameter of the funnel changes depending on a position along the Z axis. In FIG. 14, R3 corresponds to the trace of the ridge that permits the diameter to become the maximum at an arbitrary position along the Z axis.

In particular, in this third embodiment, the funnel 321 is so designed that angle θ is set smaller than the angle between the diagonal axis of the screen and the H axis. More specifically, θ is designed to satisfy the following relation:

$$\tan\theta<N/M$$

with respect to the aspect ratio M:N of the phosphor screen.

For example, if the aspect ratio of M:N is 9:16, as shown in FIG. 13, θ is set to satisfy the following relation:

$$\tan\theta<16/9$$

Even with this structure, effects such as a decrease in deflection power and leakage magnetic field, prevention of degradation of the atmospheric pressure resistance of the vacuum envelope, prevention of impingement of the electron beams on the inner surface of the funnel, and the like can be obtained, in the same manner as in the second embodiment described above.

The structure of a vacuum envelope 423 according to the fourth embodiment will be described.

Figure 15:
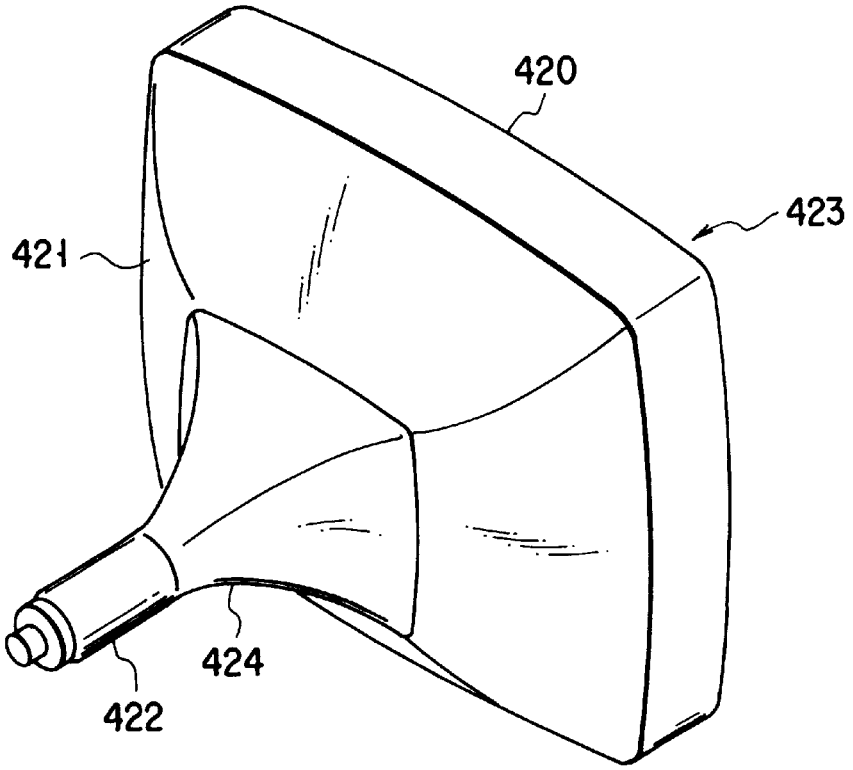
FIG. 15 is a view showing a vacuum envelope applied to a color picture tube according to the fourth embodiment of the present invention.

FIG. 15 shows a color picture tube having the vacuum envelope 423 according to the fourth embodiment. This color picture tube is horizontally elongated and has a phosphor screen having an aspect ratio of 4:3. This vacuum envelope 423 has a panel 420, a neck 422, and a funnel 421. The ratio of the long side to the short side of the panel 420 is 4:3, which is substantially equal to the aspect ratio of the phosphor screen. A section of the neck 422 in a plane perpendicularly intersecting the Z axis is circular. The funnel 421 connects the panel 420 and the neck 422. The remaining arrangement of this color picture tube is the same as that of the color picture tube of the first embodiment and a detailed description thereof will therefore be omitted.

A section of a region of the funnel 421 on which a deflection yoke is to be mounted, i.e., a section of an intermediate funnel region 424 in a plane which perpendicularly intersects the Z axis changes along the Z axis.

In the same manner as in the first embodiment, the section of this intermediate funnel region 424 from the neck 422 side to the panel 420 side along the Z axis gradually changes from a circular shape similar to that of the neck 422 to a non-circular shape having the maximum diameter along a direction other than the major and minor axes of the panel 420.

Figure 16:
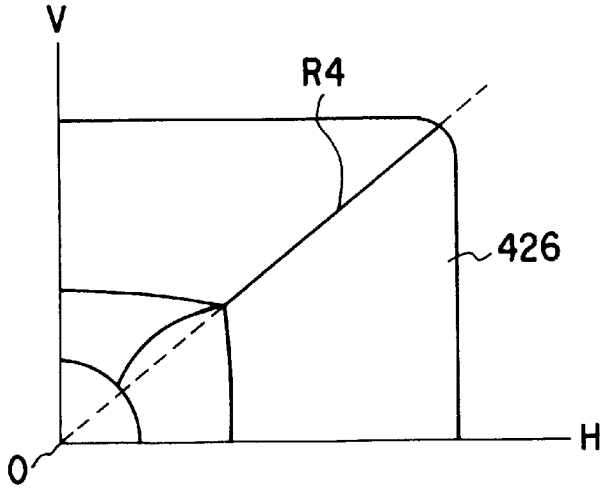
FIG. 16 is a graph showing the trace of the ridge of an intermediate funnel region extending from the neck to the panel of the vacuum envelope shown in FIG. 15.

FIG. 16 shows in a solid line R4 the trace of the ridge of the intermediate funnel region 424 extending from the neck 422 to the panel 420.

As shown in FIG. 16, of the inner and outer shapes of the section of the intermediate funnel region 424, at least the inner shape from the neck 422 side to the panel 420 side is gradually deformed from a circular shape to a non-circular shape having its maximum diameter along a direction other than the major and minor axes of the panel 420, i.e., to a rectangular shape. In addition, the section of the intermediate funnel region 424 which is perpendicular to the Z axis and located at an arbitrary point on the Z axis is formed such that, an angle θ between the H axis and a straight line connecting the intersection O between the section and the Z axis and a point corresponding to the maximum diameter of the funnel changes depending on a position along the Z axis. In FIG. 16, R4 corresponds to the trace of the ridge that permits the diameter to become the maximum at an arbitrary position along the Z axis.

In particular, in a section of the funnel 421 of this fourth embodiment, angle θ is set larger than the angle between the diagonal axis of the screen and the H axis on the neck side, and is set substantially equal to the angle between the diagonal axis of the screen and the H axis on the panel side.

This structure is designed to reduce the leakage magnetic field generated by the horizontal deflection coil of the deflection yoke. When the inner shape of the intermediate funnel region 424 is formed as described above, the diameter of the screen-side opening of the deflection yoke along the V axis is reduced, so that the leakage magnetic field from the horizontal deflection coil can be further decreased.

Even with this structure, effects such as a decrease in deflection power and leakage magnetic field, prevention of degradation of the atmospheric pressure resistance of the vacuum envelope, prevention of impingement of the electron beams on the inner surface of the funnel, and the like can be obtained, in the same manner as in the third embodiment described above.

In the embodiments described above, color picture tubes are described. However, the present invention can also be applied to a cathode ray tube other than a color picture tube.

As has been described above, in this cathode ray tube, since the outer or inner shape of the intermediate funnel region is formed to have a structure as described above, the deflection yoke to be mounted on the intermediate funnel region can be made compact while satisfying demands for a higher luminance and a higher frequency. Also, this deflection yoke can be set close to the electron beam passing region. As a result, a cathode ray tube can be provided which can decrease a deflection power corresponding to the power consumption of the deflection yoke, and a leakage magnetic field from the deflection yoke, while having a sufficiently high atmospheric pressure resistance.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A cathode ray tube comprising:

a vacuum envelope having a substantially rectangular panel, a cylindrical neck, and a funnel for connecting the panel and the neck together;

an electron gun assembly disposed in said neck to generate electron beams;

a substantially rectangular phosphor screen arranged on an inner surface of said panel to generate luminescence upon impingement of the electron beams; and a deflection yoke mounted on an outer surface of said funnel over a predetermined range along a tube axis coinciding with a central axis of the cylindrical neck, to generate a magnetic field in said funnel, deflect the electron beams in a horizontal-axis direction and a vertical-axis direction each perpendicularly intersecting the tube axis, and scan said phosphor screen, wherein, within said predetermined range along the tube axis, at least an inner surface of said funnel is formed to have a shape in a section perpendicular to the tube axis which is gradually deformed from circular at an end near the neck to non-circular at an end near the panel, and wherein, throughout said predetermined range along the tube axis where said shape is non-circular, said shape has a maximum diameter in a direction other than the horizontal-axis and vertical-axis directions, and wherein, throughout said predetermined range along the tube axis where said shape is non-circular and in a section plane which is perpendicular to the tube axis, an angle θ changes depending on a position along the tube axis, the angle θ being defined between (A) the horizontal axis and (B) a straight line connecting (B1) a point of intersection between said section plane and the tube axis and (B2) a point in the section plane corresponding to a maximum diameter of the funnel.

2. A cathode ray tube comprising:

a vacuum envelope having a substantially rectangular panel, a cylindrical neck, and a funnel for connecting the panel and the neck together;

an electron gun assembly disposed in said neck to generate electron beams;

a substantially rectangular phosphor screen arranged on an inner surface of said panel to generate luminescence upon impingement of the electron beams; and a deflection yoke mounted on an outer surface of said funnel over a predetermined range along a tube axis coinciding with a central axis of the cylindrical neck, to generate a magnetic field in said funnel, deflect the electron beams in a horizontal-axis direction and a vertical-axis direction each perpendicularly intersecting the tube axis, and scan said phosphor screen, wherein, within said predetermined range along the tube axis, at least an inner surface of said funnel is formed to have a shape in a section perpendicular to the tube axis which is gradually deformed from circular at an end near the neck to non-circular at an end near the panel, and wherein, throughout said predetermined range along the tube axis where said shape is non-circular, said shape has a maximum diameter in a direction other than the horizontal-axis and vertical-axis directions, and wherein, throughout said predetermined range along the tube axis where said shape is non-circular and in a section plane which is perpendicular to the tube axis, an angle θ satisfies the following relation:

$$\tan\theta \neq N/M,$$

the angle θ being defined between (A) the horizontal axis and (B) a straight line connecting (B1) a point of intersection between said section plane and the tube axis and (B2) a point in the section plane corresponding to a maximum diameter of the funnel, N/M being a ratio of a vertical-axis length of the phosphor screen to a horizontal-axis length thereof.

3. A cathode ray tube comprising:

a vacuum envelope having a substantially rectangular panel, a cylindrical neck, and a funnel for connecting the panel and the neck together;

an electron gun assembly disposed in said neck to generate electron beams;

a substantially rectangular phosphor screen arranged on an inner surface of said panel to generate luminescence upon impingement of the electron beams; and a deflection yoke mounted on an outer surface of said funnel over a predetermined range along a tube axis coinciding with a central axis of the cylindrical neck, to generate a magnetic field in said funnel, deflect the electron beams in a horizontal-axis direction and a vertical-axis direction each perpendicularly intersecting the tube axis, and scan said phosphor screen, wherein, within said predetermined range along the tube axis, at least an inner surface of said funnel is formed to have a shape in a section perpendicular to the tube axis which is gradually deformed from circular at an end near the neck to non-circular at an end near the panel, and wherein, throughout said predetermined range along the tube axis where said shape is non-circular, said shape has a maximum diameter in a direction other than the horizontal-axis and vertical-axis directions, and wherein, throughout said predetermined range along the tube axis where said shape is non-circular and in a section plane which is perpendicular to the tube axis, an angle θ satisfies the relation that tan θ is closer to 1 than N/M, the angle θ being defined between (A) the horizontal axis and (B) a straight line connecting (B1) a point of intersection between said section plane and the tube axis and (B2) a point in the section plane corresponding to a maximum diameter of the funnel, N/M being a ratio of a vertical-axis length of the phosphor screen to a horizontal-axis length thereof, and N/M being not equal to 1.

4. A cathode ray tube comprising:

a vacuum envelope having a substantially rectangular panel, a cylindrical neck, and a funnel for connecting the panel and the neck together;

an electron gun assembly disposed in said neck to generate electron beams;

a substantially rectangular phosphor screen arranged on an inner surface of said panel to generate luminescence upon impingement of the electron beams; and a deflection yoke mounted on an outer surface of said funnel over a predetermined range along a tube axis coinciding with a central axis of the cylindrical neck, to generate a magnetic field in said funnel, deflect the electron beams in a horizontal-axis direction and a vertical-axis direction each perpendicularly intersecting the tube axis, and scan said phosphor screen, wherein, substantially throughout the predetermined range along the tube axis, in a section plane which is perpendicular to the tube axis, a point corresponding to a maximum inner diameter of the funnel is adjacent to a point where the intersection of the electron beam with the section plane is furthest from the tube axis.

5. A cathode ray tube comprising:

a vacuum envelope having a substantially rectangular panel, a cylindrical neck, and a funnel for connecting the panel and the neck together;

an electron gun assembly disposed in said neck to generate electron beams;

a substantially rectangular phosphor screen arranged on an inner surface of said panel to generate luminescence upon impingement of the electron beams; and a deflection yoke mounted on an outer surface of said funnel over a predetermined range along a tube axis coinciding with a central axis of the cylindrical neck, to generate a magnetic field in said funnel, deflect the electron beams in a horizontal-axis direction and a vertical-axis direction each perpendicularly intersecting the tube axis, and scan said phosphor screen, wherein a dimension of the panel in a horizontal-axis direction is designated as M, a dimension of the panel in a vertical-axis direction is designated as N, and $$M \geqq N;$$

and wherein, in a sectional plane perpendicular to the tube axis, an angle θ is defined between (A) the horizontal axis and (B) a straight line connecting (B1) the point of intersection of the tube axis and (B2) a point where the inner diameter of the funnel is maximum, and wherein substantially throughout the predetermined range along the tube axis, $$|\tan \theta| \geqq N/M.$$

* * * * *